United States Patent [19]

Virta et al.

[11] Patent Number: 5,019,213

[45] Date of Patent: May 28, 1991

[54] METHOD AND APPARATUS IN THE DRYING SECTION OF A PAPER MAKING MACHINE FOR SPEEDING THE THREADING OF A PAPER OR PAPERBOARD WEB

[75] Inventors: Raimo Virta; Vesa Vuorinen, both of Turku; Reijo Ruottu, Kaarina, all of Finland

[73] Assignee: Valmet Paper Machinery Inc., Finland

[21] Appl. No.: 513,544

[22] Filed: Apr. 24, 1990

[30] Foreign Application Priority Data

May 2, 1989 [FI] Finland ..... 892099

[51] Int. Cl.[5] ..... D21F 5/02

[52] U.S. Cl. ..... 162/193; 34/117

[58] Field of Search ..... 34/116, 117, 120, 123, 34/34, 23, 41; 162/193

[56] References Cited

U.S. PATENT DOCUMENTS

| | | | |
|---|---|---|---|
| 2,714,342 | 8/1955 | Beachler | 162/370 |
| 4,477,983 | 10/1984 | Andersson | 34/116 |
| 4,625,434 | 12/1986 | Karlsson | 34/123 |
| 4,628,618 | 12/1986 | Virta et al. | 34/116 |
| 4,648,942 | 10/1987 | Wanke | 162/193 |
| 4,684,443 | 8/1987 | Kerttula et al. | 34/120 |

*Primary Examiner*—Richard V. Fisher
*Assistant Examiner*—Brenda Lamb
*Attorney, Agent, or Firm*—Steinberg & Raskin

[57] ABSTRACT

A method and apparatus in a drying section of a paper making machine wherein a so-called single-wire draw is applied and wherein blow boxes (20) are used, which are intended to prevent phenomena that disturb the mutual support contact between the web (W) and the drying wire (12). The blow boxes (20) extend across the entire width of the web (W), and they communicate with members (17, 18, 21, 22) that supply blow air, and they are provided with at least two nozzle slots (13, 14) transverse to the running and longitudinal direction of the web (W) as well as with a carrier face (16) between said nozzle slots. Negative pressure is produced in the space (A-) defined by the carrier face (16) and the drying wire (12) by means of the ejection and prevention effects of the air jets ($F_1$, $F_2$) blown through the nozzle slots (13,14). In order to speed the threading of the web (W), in the blow boxes (20) the blow sections ($24_{k+1}$. . . $24_N$) that remain outside the transverse area (A) of the leader band (R) are closed. The blowing, which has thereby been intensified, is applied through both of the opposite nozzles (13, 14) of the blow boxes (20) in connection with the threading only within the area (A) comprising the width ($L_R$) of the leader band (R).

9 Claims, 3 Drawing Sheets

METHOD AND APPARATUS IN THE DRYING SECTION OF A PAPER MAKING MACHINE FOR SPEEDING THE THREADING OF A PAPER OR PAPERBOARD WEB

BACKGROUND OF THE INVENTION

The invention concerns a method in the drying section of a paper machine wherein a so-called single-wire draw is applied and wherein blow boxes are used, which are supposed to prevent phenomena that disturb the mutual support contact between the web and the drying wire, in particular formation of positive pressures in the nips defined by the drying wire and a cylinder face, which blow boxes extend across the entire width of the web, communicate with members that supply blow air, and are provided with at least two nozzle slots or the equivalent transverse to the running and longitudinal direction of the web as well as with a carrier face between the nozzle slots, the carrier face together with the drying wire defining a space.

The invention further concerns an apparatus intended for carrying out the method in accordance with the invention in the area of single-wire draw in the drying section of a paper machine, the device comprising blow boxes, which are fitted substantially across the entire width of the web and which communicate with members which supply blow air, and which blow boxes are provided with at least two nozzle slots or the equivalent transverse to the running and longitudinal direction of the web.

The present invention is applied in connection with a so-called single-wire draw, which, in the present application, means a method of drawing the web over heated drying cylinders in a cylinder group wherein the web runs from one line of cylinders to the other while being supported by one and the same drying wire or fabric so that on one line of cylinders the web is between the drying wire and the cylinder face, and on the other line of cylinders the web is outside the cylinders and the drying wire is between the cylinder face and the web, and the web runs along the draws between the lines of cylinders as supported by the drying wire. It is an advantage of this single-wire draw that the web is continuously supported by the drying wire, and the web has no, or at least no substantially long, open draws, whereby the risk of wrinkles in, and breaks of, the web is reduced.

It is well known that a thin layer of air follows and remains in contact with a moving face so that no gliding takes place between the air and the moving face, but those particles of air that are in contact with the moving face travel at the same speed as the face itself.

In the following, the gap defined by the fabric, such as the drying wire, and by the cylinder or roll face in drying sections in paper machines is called the inlet nip when the fabric arrives in this gap, and the outlet nip when the fabric departs from the gap. If all the faces that define the nip are impenetrable by air, air flows of opposite directions in relation to the gap between the boundary layers are formed both in the inlet nip and in the outlet nip. Thereby, in the inlet nip, owing to the damming effect of the boundary layer flows, a positive pressure is produced across the fabric, and in the outlet nip, owing to the suction effect of the boundary layer flows, a negative pressure is produced across the fabric.

As is known from the prior art, when fabrics penetrable by air, such as wires, are used, the differences in pressure across the fabric, produced by the boundary layer flows, usually produce detrimental air flows through the fabric.

Several prior-art pocket-ventilation devices in paper machines are based on the pumping effect of open drying wires.

As is known from the prior art, the first and the second drying groups in a paper machine are usually provided with said single-wire draw, which is frequently accomplished so that on the upper cylinders the paper web is between the wire and the cylinder, and on the lower cylinders the web is on the wire.

In the Applicant's FI Patent 69,332 (corresponding to U.S. Pat. No. 4,628,618), a device is described that is intended for use in the drying section of a paper machine to prevent phenomena that disturb the mutual support contact between the web and a fabric, such as the drying wire, in particular formation of positive pressures in the gaps or nips defined by the wire and by the cylinder face. This device essentially comprises a blow box extending across the entire width of the web and communicating with members that produce blow air, and said blow box is provided with at least two nozzle slots or the equivalent transverse to the running and longitudinal direction of the web. In the FI Patent 69,332 it is considered novel that, in the device, between said nozzle slots, there is a planar carrier face, whose distance from the fabric facing it is about 10 . . . 30 times, preferably about 15 . . . 25 times the width of said nozzle slot, as well as that, in the space between said plane carrier face and the fabric placed facing it, negative pressure is produced primarily or exclusively by means of the ejection effect of air jets blown through the nozzle slots.

In recent years, the running speeds of paper machines have been increasing constantly, and now a speed of 1500 m/min is being approached. In such a case, fluttering of the web and its detaching from the support fabric become a serious problem detrimental to the running quality of a paper machine.

The threading of the web has become a particularly difficult problem in the area of single-wire draw and especially in connection with the blow boxes or their equivalent described in the FI patent 69,332. The difficulties in threading can be such a bottleneck in the process as to present increasing of the speed of a paper machine to about 1500 m/min or above. In connection with blow boxes in accordance with the FI patent or its equivalent, the threading of the web is made more difficult by the large blow quantities at the service side of the paper machine and by the blowings from the lateral nozzle at the service side, which tend to carry the leader, which has been cut-off from the web, towards the side and thereby cause failures in the threading of the web, which failures substantially increase the time taken for the web to pass through the paper making machine.

The drying wire used in the area of single-wire draw also makes the use of a system of threading ropes more difficult, mainly because the threading ropes must be placed outside the widths of the normal web and wire. In such a case, in connection with threading, the leader band must be detached from the drying wire and be shifted laterally in the area of the threading ropes. Such lateral shifting is particularly problematic in paper machines in which the draw of the web is fully closed from the press section to the dryer.

With the use of prior-art lateral nozzles of blow boxes which keep the web in contact with the wire also in the lateral areas, there has been a problem that, when the blowing of the lateral nozzle placed at the service side of the machine is directed in the plane of the wire towards the threading ropes, the blowing detaches the leader from the threading ropes.

OBJECTS AND SUMMARY OF THE INVENTION

The principal object of the method and apparatus of the present invention is to avoid or at least to reduce the problems discussed above by means of a simple method and apparatus. This principal object is achieved by constructing a blow box apparatus having controllable nozzles therein such that appropriate control of these nozzles produces negative pressure in a space within the blow box which facilitates threading of a paper web therethrough.

In the practical embodiment of the above FI Patent 69,332, the blow box, i.e. the so-called UNO-RUN (TM) tube, is divided into sections in the transverse direction of the web for the purpose of regulating the distribution of air in this direction and thereby to control the transverse moisture profile of the web to be dried. The width of said sections in the transverse direction of the machine is usually about 0.5 . . . 1.0 m. In the prior art, these sections are not regulated in any particular way in connection with the threading of the web.

In view of achieving the objectives stated above and those that will be hereinafter explained, the method of the invention is mainly characterized in that a negative pressure is produced in a suction or blow box by means of the ejection and prevention effects of air jets blown through nozzle slots therein, and that, in order to speed the threading of the web, in the blow boxes, the sections of the blow box that remain outside the area of the leader band are closed and that the blowing, which has been thereby further intensified, is applied through both of the opposite nozzles of the blow boxes in connection with the threading substantially only within the area comprising the width of the leader band.

Also, the device in accordance with the invention is characterized in that between adjacent nozzle slots there is a planar carrier face which, together with the drying wire that runs facing it, defines a space, in which a negative pressure can be produced primarily or exclusively by means of the ejection and prevention effects of the air jets blown through these nozzle slots, that said blow boxes are divided into sections in the transverse direction of the web, these sections opening into the nozzle slots and each of these sections being provided with regulation members, by means of which the amount of air passing into each section can be regulated, and that the device includes arrangements by means of which the sections placed outside the area of the leader band can be closed and, in a corresponding way, the sections placed in the area of the leader band can be opened so as to produce intensified air blowings on the leader band across its width.

According to the invention, in a single-wire draw, in the area of the wire where the threading takes place, i.e. at the service side of the machine, a sufficiently high negative pressure is produced, by which means the leader band of the web is sucked into contact with the wire, and thereby the leader band is supported so that it runs in a stable manner without threading ropes, which are difficult to arrange or to use, at least in the area of single-wire draw. In the area of twin-wire draw, if necessary, it is possible to use normal, prior-art systems for threading ropes.

By means of the method and device in accordance with the invention, it is possible to prevent transverse air flows, which, in the prior art, caused wandering of the leader band in the transverse direction of the machine.

According to the invention, an advantageous additional function has been obtained for the blow boxes necessary in single-wire draw in connection with the threading of the web being facilitated without the necessity of increasing or substantially changing the constructions of the blow means. Thereby, the value of the blow boxes is increased considerably.

In a preferred embodiment of the invention, in connection with the lateral nozzle placed in the machine direction at the service side of a paper machine, an additional nozzle parallel to said lateral nozzle is used, by means of which the air jet of the lateral nozzle proper is turned to be directed so that it bypasses the threading ropes placed facing it, so that the blowings of the lateral nozzle do not detach the leader band from the ropes. When this embodiment is used, the lateral nozzle at the service side of the paper making machine does not have to be closed during the time of threading, whereby the negative pressure in the suction area of the suction box remains as high as possible even at this time.

BRIEF DESCRIPTION OF THE DRAWINGS

In the following, the invention will be described in detail with reference to an exemplifying embodiment of the invention illustrated in the figures in the accompanying drawing, the invention being in no way strictly confined to the details of said embodiment.

PREFERRED EMBODIMENTS OF THE INVENTION

Figure 1:
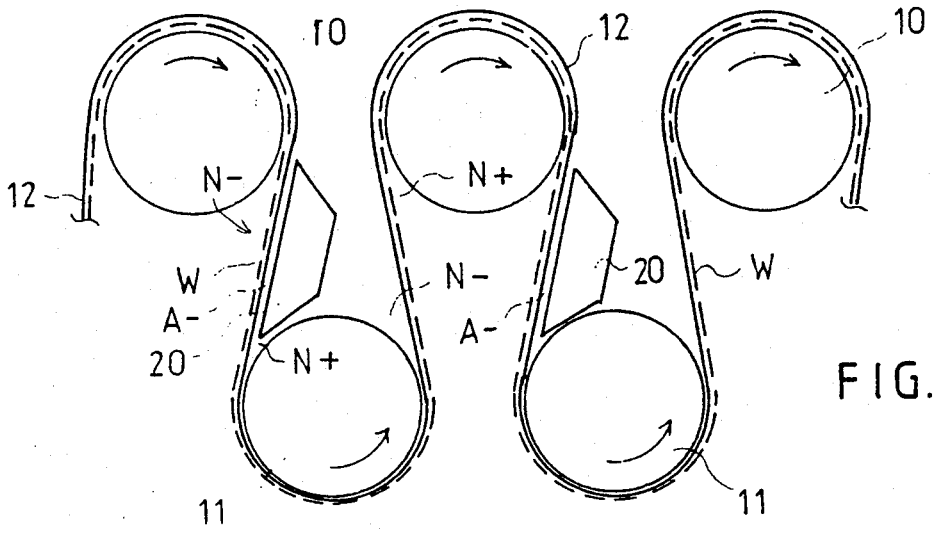
FIG. 1 is a schematical side view of an area of single-wire draw wherein the Applicant's UNO-RUN TM blow tubes or boxes are applied.

As is shown in FIG. 1, a multi-cylinder dryer for paper web W, e.g. its first drying group, comprises a line of upper cylinders 10 and corresponding line of lower cylinders 11, which cylinders 10, 11 are heated by means of steam. In the group of cylinders 10, 11, a single-wire draw is applied so that the web W runs with the support of the drying wire 12 throughout the entire group, so that on the line of upper cylinders 10 the web W is in direct contact with the cylinder 10 face, and on the lower cylinders 11 the web is outside the single-wire draw. The drying wire 12 is, as a rule, penetrable by air, and its permeability is preferably in the area of 600–3000 $m^3/hm^2$.

By the effect of the web-wire combination 12/W, owing to boundary layer flows, a negative pressure tends to be formed in the outlet nips N−, and correspondingly a positive pressure tends to be formed in the inlet nips N+.

Figure 2:
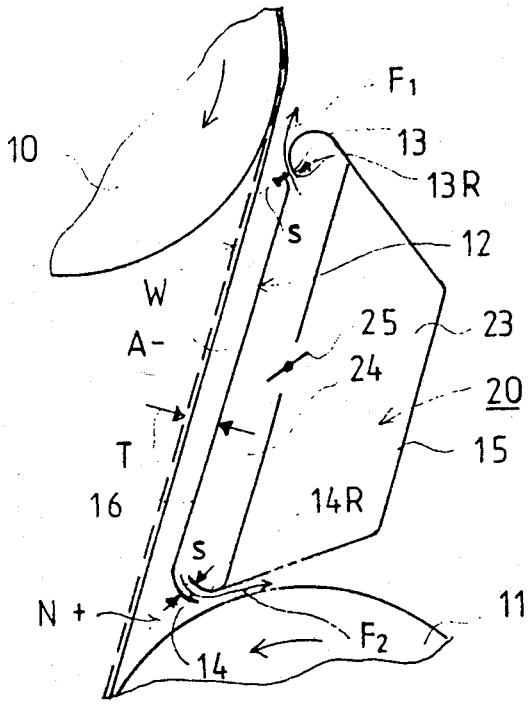
FIG. 2 is a vertical sectional view in the machine direction of a UNO-RUN TM blow box.

As is shown in FIGS. 1 and 2, against the wire 12 on its run from one line of cylinders to the other, in the gaps N+ defined by the cylinders 10, 11 and by the wire 12, a blow box 20 is placed, which has two nozzle slots 13 and 14 placed in the transverse direction of the web W and extending across the entire width of the web W. The air jet $F_1$ discharged out of the first nozzle slot 13 is directed in the direction opposite to the direction of running of the wire F placed facing the nozzle slot, and the air jet $F_2$ discharged out of the second nozzle slot 14 is directed in the direction opposite to the direction of running of the circumference of the cylinders 10, 11. Between the nozzles 13 and 14, the box 20 has a carrier face 16, which is planar and substantially parallel to the wire 12 and web W that run substantially parallel to the carrier face.

Figure 3:
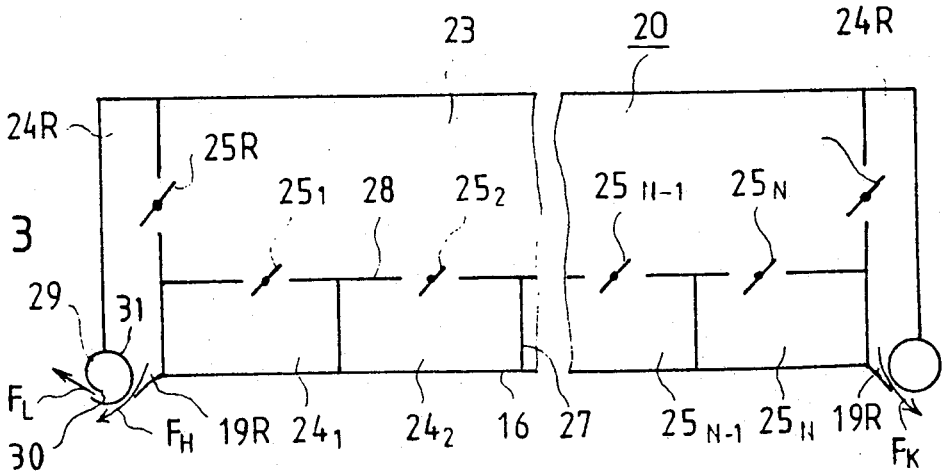
FIG. 3 is a vertical sectional view in the transverse direction of the paper machine of FIG. 2.

The distance of the carrier face 16 from the wire 12 is chosen so that the cross-sectional flow areas of the negatively pressurized space A− placed in connection with the carrier face 16 are sufficiently large, and the flow resistances occurring in connection with the carrier face sufficiently small, such that, in connection with the carrier face 16, it is possible to maintain a sufficiently high level of negative pressure by means of the ejection-prevention effects of the blowings $F_1$, $F_2$ as well as by means of the lateral blowings $F_3$ (FIG. 3). The distance of the carrier face 16 from the wire 12 (dimension T) is, as a rule, about 10 . . . 30 times, preferably about 15 . . . 25 times the width of the nozzle slots 13 and 14 (dimension s). The length of the carrier face 16 in the direction of running of the web W can be chosen freely in accordance with the length of the run on which the mutual support contact between the web W and the wire 12 is supposed to be improved, thereby preventing the drawbacks occurring in the prior art apparatuses. The carrier face 16 and the area between the nozzles 13 and 14 are extended across the entire run of the web W and of the wire 12 from one line of cylinders to the other.

Figure 5:
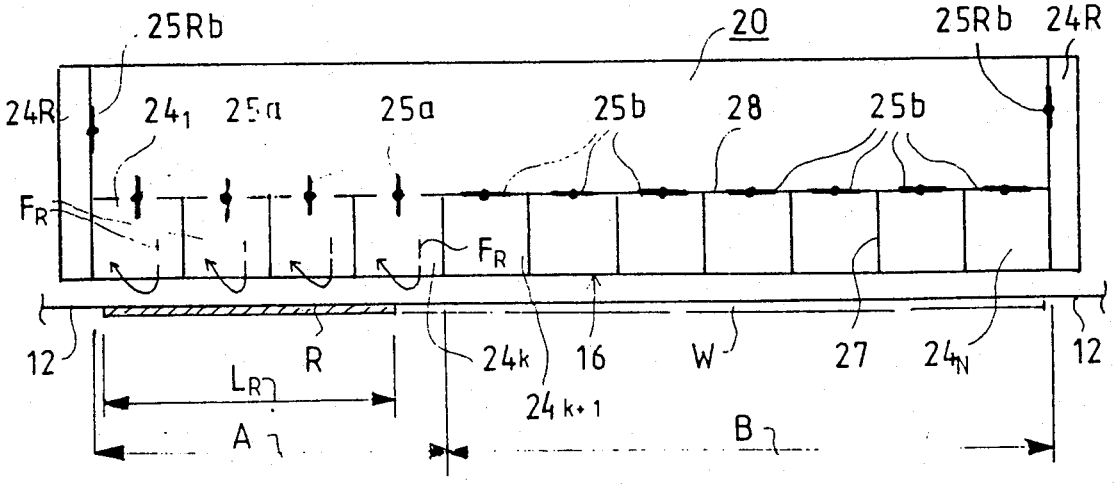
FIG. 5 is a vertical sectional view of the preferred embodiment of the invention shown in FIG. 4 in the transverse direction of the machine, at the level of the blow box, the regulation means of the blow box being positioned for the distribution of air required by threading.

As is shown in FIGS. 3 and 5, the blow box 20 includes a compartment 23, which communicates with the end compartments 24R by the intermediate elements comprising regulation dampers 25R. From the end compartments 24R, the nozzle slots 19R are opened, which have curved Coanda nozzle faces 26R in connection with the tube parts 29. Out of the nozzle slots 19R, lateral blowings $F_H$ and $F_K$ are directed at the lateral areas of the web W to maintain a sufficient negative pressure in the carrier area A−. Out of the compartment 23, air ducts are opened through t he regulation dampers $25_l$ . . . $25_N$ into the sections $24_l$ . . . $24_N$ in the box 20. The sections $24_l$ . . . $24_N$ are defined by the wall of the carrier face 16, on one hand, and by the vertical partition walls 27 in the machine direction, on the other hand, as well as by the transverse wall 28, in whose openings there are regulation gates $25_l$ . . . $25_N$. Thus, the box 20 is divided into N pcs. of sections, in addition to which there are two end sections 24R. The blow box solution described above is generally known in the prior art, and it is based on the Applicant's said FI Patent 69,332.

The present invention relates to the threading of the web W and to a novel operation of a blow box 20 in connection with the threading of the web W. As is well known, out of the paper web W, a leader band R is cut-off by means of a so-called diagonal cutter e.g., in the press section, the width of said leader band R being denoted with $L_R$ in FIG. 4. The rest of the web W is passed, in connection with the threading, e.g., into the pulper placed underneath the press section. In the invention, the blow boxes 20 are utilized in a novel way in the threading of the web in the area of single-wire draw while making use of the drying wire 12. The problems of threading have become ever more difficult with increasing running speeds of paper machines and especially when the speed of 1500 m/min is approached. As is shown in FIG. 4, blow air is blown into the blow boxes 20 through a blower 18 and through the ducts 17, 21, 22.

Figure 4:
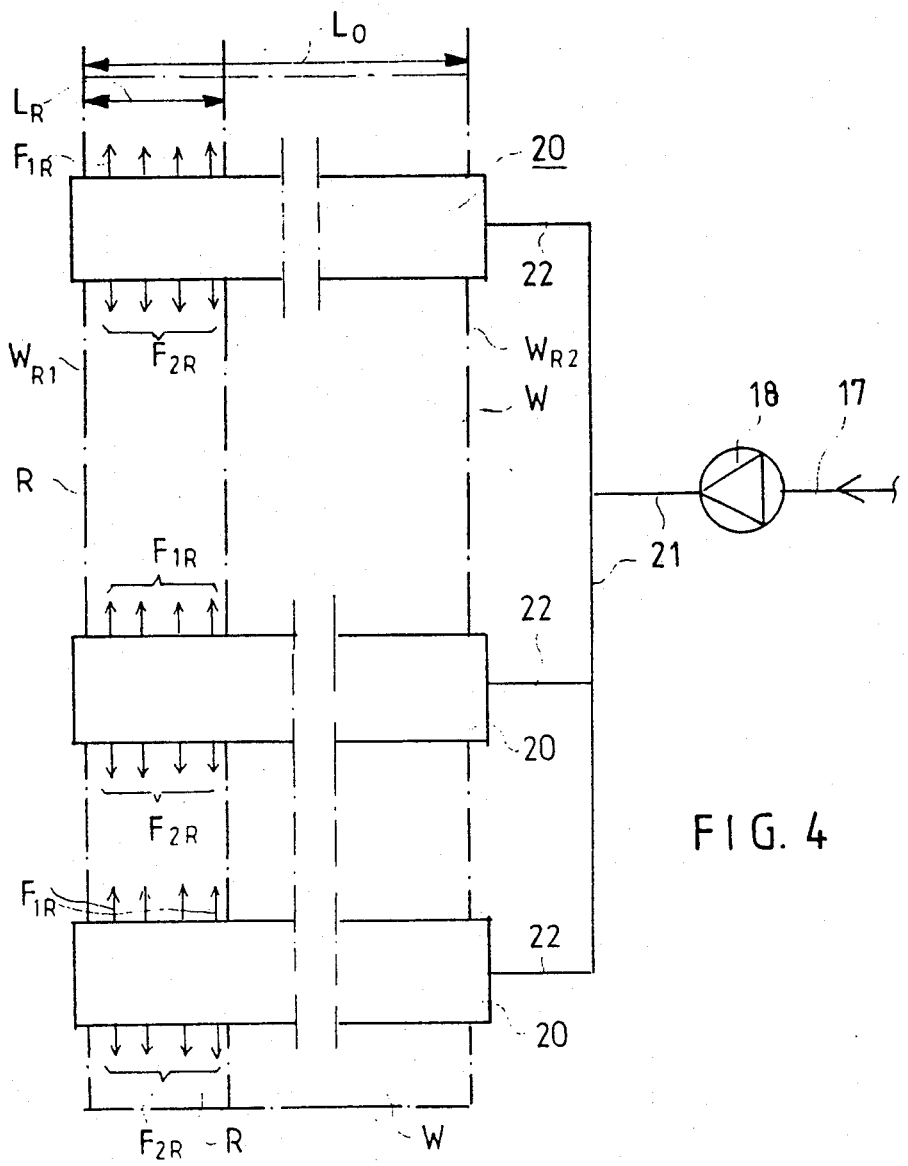
FIG. 4 is a schematical illustration of the air-distribution method that is applied in a preferred embodiment of the invention.

In FIG. 4, the entire width of the web W is denoted with $L_O$. According to the method of the invention (FIG. 5), in the transverse area B of the web W that remains outside the leader band R, the regulation dampers **25*b* of the sections $24_{k+1}$ . . . $24_N$ are closed. The regulation dampers 25*a* of the sections $24_l$ . . . $24_K$ (k−4 in FIG. 5) in the transverse area of the width $L_R$ of the leader band R are allowed to remain in the open position. The regulation dampers of the end sections $24_1$ . . . $24_k$ placed in the area of the leader band, the blowings $F_R$ are directed in such a way that the blowings $F_{1R}$ are directed out of the nozzles 13 of the open sections, and the blowings $F_{2R}$ are directed through the nozzles 14, across the entire width $L_R$ of the leader band R. In this way, a maximal negative pressure is obtained on the width $L_R$ of the leader band R in connection with the carrier face 16 of the open sections, i.e., in the space A− an intensified negative pressure is produced, which sucks the leader band R into contact with the wire 12** and thereby supports the leader band R as it travels through the area of single-wire draw.

When the invention is being applied, the sections $24_l$ . . . $24_k$, counting from the service side of the paper making machine, are always kept open within an area of a width of about 0.5–2 m, and the other sections $24_{k+1}$ . . . $24_N$ are closed during the time of threading.

Figure 6:
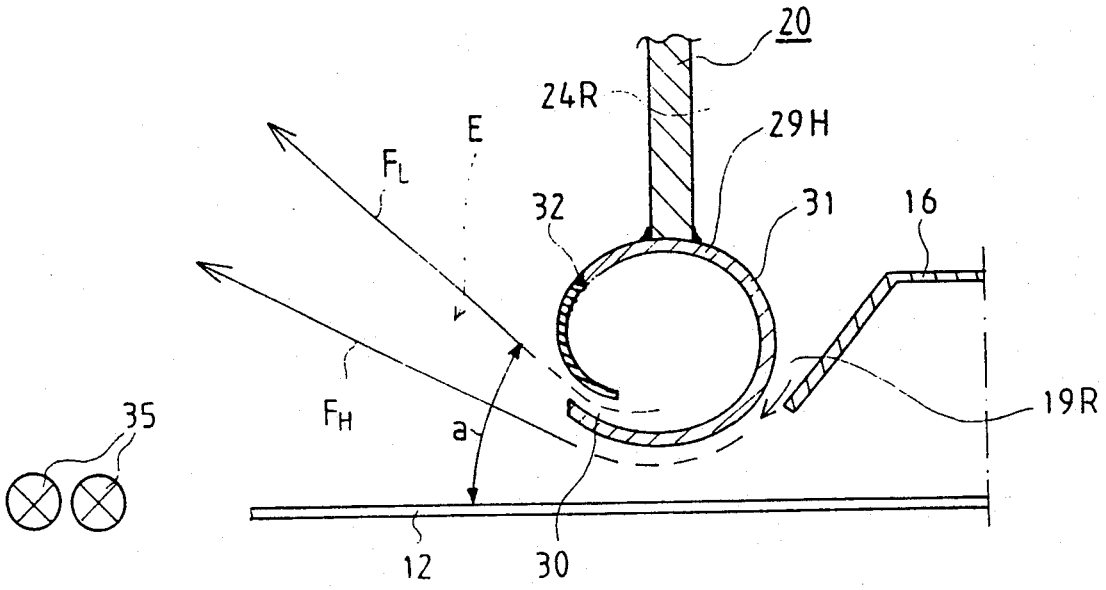
FIG. 6 is a transverse sectional view of a lateral nozzle provided with an additional nozzle slot.
Figure 7:
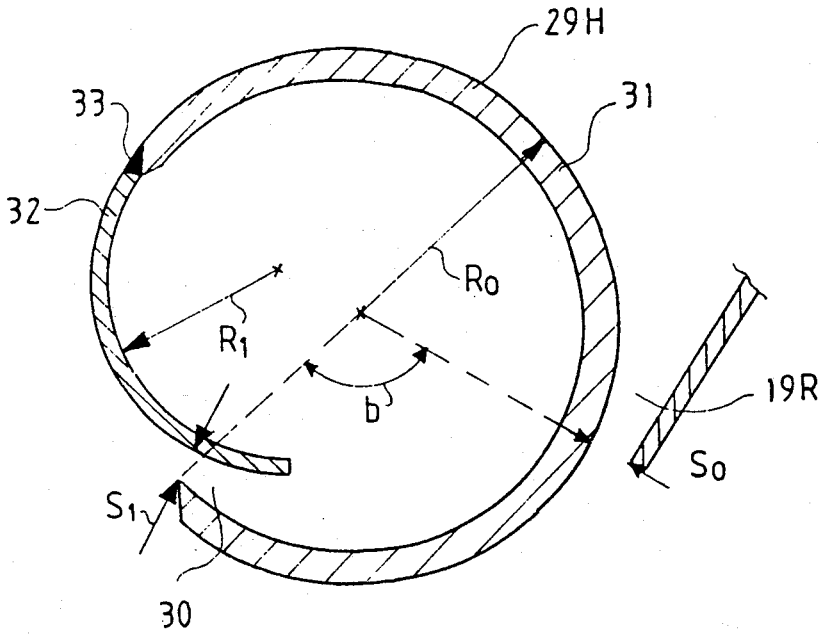
FIG. 7 is an enlarged sectional view of the arrangement of the lateral nozzle shown in FIG. 6.

FIGS. 6 and 7 give a description of a preferred embodiment of a service-side lateral nozzle, which consists of a tubular part 29H that is provided with a additional nozzle slot 30. The longitudinal directions of the nozzle slot 19R proper and the additional nozzle slot 30 are parallel to each other. The tube part 29H is composed of a tube portion 31 of constant radius $R_o$, from which a segment has been cut from one side and replaced by a curved part 32 of smaller curve radius $R_l < R_o$, the curved part 32 being attached by means of a welding joint, so that a nozzle slot 30 is formed between the partly overlapping parts 31 and 32. Out of the nozzle slot 30, an additional blow $F_L$ is blown, whose angle a relative to the wire 12 plane is within the range of a=40° to 60°. By means of the additional blowing $F_L$, the lateral blow $F_H$ proper coming out of the nozzle slot 19R can be made to turn out of the wire 12 plane towards the additional blow $F_L$ by means of an ejection effect produced in the area E, so that the lateral blow $F_H$ is not applied to the threading ropes 35. Thus, the blowing $F_H$ does not detach the leader band from the ropes 35, and thereby it does not hamper the threading.

When an additional nozzle slot 30 as shown in FIGS. 6 and 7 is used, the lateral nozzle slot 19R and the regulating damper 25R for its compartment 24R are not needed, or the damper does not have to be closed during the time of threading. This arrangement provides the advantage that the negative pressure in the suction area of the suction box is maintained at a maximal level during threading.

As is shown in FIG. 7, the nozzle slot 19R proper is placed, in the direction of blowing, at the distance of a certain central angle b of the tube part 31 from the additional nozzle slot 30. The magnitude of the angle b is preferably in the range of b=90° to 120°, in which case the wall of the tube part 31 placed within said sector b acts as a Coanda face, which turns the blowing $F_H$ and makes it parallel to the wire 12 plane, from which direction the additional blowing $F_L$ (FIG. 6) turns the blowing $F_H$, by means of its ejection effect in the area E, from the wire 12 plane to the angle c, which is, generally in the range c=20° to 40°.

The additional nozzle 30 is arranged to extend over most of the length of the carrier face 16 in the machine direction, for example, so that the additional nozzle 30 starts and ends about 20 to 100 mm before the transverse edge of the carrier face 16.

It should be noted that in FIG. 6 the arrows $F_L$ and $F_H$ represent just the main directions of the blowings. In reality these blowings $F_L$ and $F_H$ are distributed over certain rather narrow sectors.

In the following, an example will be given which illustrates the operations of the invention:

Assume that the width of web $L_O$=9 m. In a normal situation, the amount of air blown through the pipe 21 and through all the boxes 20 out of the nozzles 13, 14, 19R is V=9000 $m^3$/h/box 20 when all the sections $24_l$. . . $24_V$ are open. The boxes 20 comprise a total of 9 sections, whereby N=9.

In a threading situation, the sections 1 . . . 4 (k=4) are open and the sections 5 . . . 9 are closed. In such a case, the pressure losses are increased to such an extent that the amount of blown air passing through each box is=7000 $m^3$/h, i.e. in the sections 1 . . . 4, which are open, the blowing is=7000/4=1750 $m^3$/h/section. In such a case, the blow amount through the open sections $24_l$. . . $24_k$ is increased from the value of 1000 $m^3$/h/section to the value of 1750 $m^3$/h/section. The dimensions of the lateral nozzles own in FIG. 7 are chosen, e.g., as follows. The radius $R_o$ of the tube part 29H is $R_o$=1-0-30 mm, the radius $R_l$ of the Coanda wall 32 of the additional nozzle is $R_l$=15 to 40 mm, the width $S_o$ of the nozzle slot 30 in the additional nozzle is $S_l$=1 to 5 mm, the width So of the nozzle slot 19R in the lateral nozzle is $S_o$=1 to 5 mm.

According to the above example, with the width $L_R$ of the leader band being R, the negative pressure applied to the leader band through the drying wire !2 on the run between cylinder lines can be increased substantially with the result that the threading is speeded up and becomes more reliable so that, in the area of single-wire draw, it is not necessary to use a system of threading ropes, which threading ropes cause additional problems in the single-wire draw area.

According to the invention, in connection with threading, when blowings from the boxes 20 to the area B outside the leader band R are prevented, the amount of air to be blown is lowered to about 60 . . . 75% of the original, but since, according to the invention, the blowings are applied to a narrow lateral area only, the negative pressure can be intensified without the necessity of using any additional blowings or special arrangements in connection with the threading, and the UNO-RUN TM boxes, which are themselves included in the equipment, can thereby also be made to operate advantageously in connection with a threading operation.

Although preferred embodiments of the subject invention have been shown herein, it is submitted that numerous other embodiments within the scope of the appended claims will readily occur to those skilled in the art.

What is claimed is:

1. In a method for speeding the threading of a paper or paperboard web in a paper or paperboard making machine of the type wherein a single-wire draw is applied and said threading is facilitated by cutting said web to form a leader band, and wherein at least one blow box is used to facilitate contact between said web and a drying wire by preventing the formation of respective positive fluid pressures in a plurality of nips respectively defined by said drying wire and a plurality of drying cylinders, said method comprising the steps of:

providing said at least one blow box with a plurality of closable blow sections and providing said at least one blow box with at least two nozzles respectively having slots whose openings face substantially transversely to the running direction of said web and with a carrier face between at least two adjacent said nozzle slots, said carrier face and said drying wire defining a space, said blow box extending at least across the entire width of said web;

producing negative pressure in said space by blowing air jets through said at least two of said nozzle slots; and closing those of said plurality of closable blow sections that are located such that they are not substantially transverse to any portion of said leader band of said web;

opening those of said plurality of closable blow sections that are located such that they are substantially transverse to said leader band of said web;

the improvement comprising the steps of providing one or more threading ropes contacting said leader band, and providing a plurality of lateral nozzles in said at least one blow box and another plurality of nozzles in said at least one blow box, each of said plurality of lateral nozzles being respectively connected to a respective one f said another plurality of nozzles, blowing air blown through said lateral nozzles, and also blowing air flows through said another plurality of nozzles to respectively alter the paths of said air blown through said lateral nozzles such that said air flows through said lateral nozzles are turned away from said one or more threading ropes so that they do not blow said leader band away from said one or more threading ropes.

2. The method of claim 1, further comprising the step of closing respective ones of said plurality of lateral nozzles which lateral nozzles are located closely proximate to said leader band such that transverse air flows interfering with said threading are substantially reduced.

3. The method of claim 1, further comprising the step of providing said plurality of closable blow sections with respective dampers which effectuate said opening and said closing of said plurality of closable blow sections.

4. In apparatus for speeding the threading of a web in a paper or paperboard making machine, said apparatus comprising:

means for cutting said web to form a leader band;

a plurality of blow boxes located at spaced intervals from each other and each of said blow boxes extending at least substantially across the entire width of said web and being in close proximity thereto, each of said blow boxes comprising at least two nozzles having openings facing transversely to the running direction of said web;

means for supplying air to each of said one or more blow boxes;

each of said blow boxes comprising a planar carrier face situated between adjacent ones of said at least two nozzles;

a drying wire which with said planar carrier face defines a space;

means for blowing air jets through said nozzles and thus producing negative pressure in said space;

each of said plurality of blow boxes comprising therein a plurality of walled sections, each of said sections opening into at least two slots of said nozzles and each of said sections comprising regulating means by which the amount of air passing therein can be regulated; and said apparatus further comprising means capable of closing said regulating means of said sections not substantially transverse to any portion of said leader band of said web and also capable of opening said regulating means of said sections which are substantially transverse to any portion of said leader band such that intensified flowings of air can impinge across the width of said leader band;

the improvement comprising said blow boxes having a plurality of tubular portions and a plurality of lateral nozzles and a plurality of additional nozzles within said tubular portions with at least one of said lateral nozzles and one of said additional nozzles within each of said tubular portions, said one lateral nozzle and said one additional nozzle respectively having longitudinal axes substantially parallel to each other, and said additional nozzle being directed to blow air at an angle relative to the plane of said drying wire such that the air blown out of said additional nozzle turns the air blown out of said lateral nozzle away form said plane of said drying wire and said apparatus also comprising one or more threading ropes, said threading ropes being located proximate to an edge of said drying wire such that said air blown out of said lateral nozzle is also turned away from said at least one threading rope.

5.7 The apparatus of claim 4, wherein each of said plurality of lateral nozzles comprises a tubular section of constant radius and a curved section having a radius smaller than said constant radius, said curved section being directly attached to said tubular section and said additional slot being defined by a lateral area of said curved section and a lateral part of said tubular section.

6. The apparatus of claim 4, further comprising means for regulating opening and closing of said lateral nozzles so as to affect said threading of said web.

7. The apparatus of claim 6, wherein said means for regulating comprises a plurality of respective dampers for said lateral nozzles.

8. The apparatus of claim 4, further comprising two lines of drying cylinders and wherein said carrier face is a planar wall which runs substantially parallel to said drying wire as said drying wire runs between said two lines of drying cylinders.

9. The apparatus of claim 8, further comprising a plurality of blow sections partially defined by said planar wall and said apparatus comprising a plurality of substantially vertical partitions further defining said blow sections and said apparatus further comprising a transverse wall still further defining said blow sections, said transverse wall having therein a plurality of dampers for regulating an air flow into said blow sections.

* * * * *